US005202615A

United States Patent [19]

An

[11] Patent Number: 5,202,615

[45] Date of Patent: Apr. 13, 1993

[54] ARC SUPPRESSING MEANS FOR CATHODE RAY TUBE

[75] Inventor: Byeong-yong An, Pusan, Rep. of Korea

[73] Assignee: Samsung Electron Devices Co., Ltd., Kyunggi, Rep. of Korea

[21] Appl. No.: 574,217

[22] Filed: Aug. 29, 1990

[51] Int. Cl.[5] ..... H01J 29/46

[52] U.S. Cl. ..... 313/456; 313/451; 313/457; 313/482

[58] Field of Search ..... 313/451, 456, 457, 482, 313/250, 262, 268, 289; 315/8; 361/2, 220, 230; 439/181, 182, 183, 186

[56] References Cited

U.S. PATENT DOCUMENTS

| | | | |
|---|---|---|---|
| 1,931,831 | 10/1933 | Römhild | 313/262 |
| 1,985,519 | 12/1934 | Ruben | 313/289 |
| 1,997,196 | 4/1935 | McNally | 313/262 |
| 2,018,174 | 10/1935 | Kayko | 313/262 |
| 2,195,914 | 4/1940 | Baier | 313/457 |
| 3,979,634 | 9/1976 | Jaillet et al. | 313/456 |
| 4,338,543 | 7/1982 | Haydel | 313/457 |
| 4,353,006 | 10/1982 | Schade | 313/457 |
| 4,366,415 | 12/1982 | Takenuda et al. | 313/457 |

FOREIGN PATENT DOCUMENTS

| | | | |
|---|---|---|---|
| 0215168 | 4/1957 | Australia | 313/457 |

*Primary Examiner*—Donald J. Yusko
*Assistant Examiner*—N. D. Patel
*Attorney, Agent, or Firm*—Cushman, Darby & Cushman

[57] ABSTRACT

An arc suppressing device for a cathode ray tube having an evacuated glass envelope which includes a funnel with a neck and a panel provided with a shadow mask. An electron gun is housed in the neck and includes a cathode and a plurality of electrodes supported by supporting beads. On the outer surface of the focusing electrode, at least one or more projecting metallic pieces pass through the supporting beads so that the ends thereof are exposed to the outside of the supporting bead. Between the ends of the projecting pieces and the inner surface of the neck, an electric field is formed to effectively prevent the occurrence of arcing in the bead channels.

2 Claims, 2 Drawing Sheets

ARC SUPPRESSING MEANS FOR CATHODE RAY TUBE

FIELD OF THE INVENTION

The present invention relates to a cathode ray tube, and particularly, to a means for suppressing an arc caused by leakage currents in the electron gun of the cathode ray tube.

BACKGROUND OF THE INVENTION

Generally, a color cathode ray tube includes an evacuated glass envelope having a funnel with a neck and a panel. An electron gun is housed in the neck and includes a cathode and a plurality of electrodes supported by supporting beads. A shadow mask is installed within the panel and spaced from the screen.

On the rear end of the neck, a plurality of terminals are provided for transmitting a video signal and a focusing voltage to an electron gun. On the outer surface of the funnel, an anode cup is electrically connected to an anode electrode which is a final accelerating electrode of the electron gun.

In the cathode ray tube, the electron gun is operated by a video signal and a control voltage applied through the terminals on the rear end of the neck and the anode cup of the funnel. A picture is displayed on the screen upon arrival of the emitted electron beam from the electron gun. As noted above the electron gun is mounted within the neck of the cathode ray tube. Voltages of very low potential are applied to the inner surface of the neck and voltages of very high potential are applied to the focusing anode. As a result, an arc may be generated by leakage currents formed within the inner surface of the neck. The leakage currents travel longitudinally through the spaces which are referred to as bead channels, between the electrode supporting beads and the inner surface of the neck.

A method for suppressing an arc generated by the leakage currents is disclosed in U.S. Pat. No. 4,338,543 and the device shown herein in prior art FIG. 4.

FIG. 1 illustrates a broken away perspective view of the neck portion 11 of the cathode ray tube 20 of the prior art (see FIG. 4) wherein there is provided an electron gun 10. A metallic band 15 is banded around supporting beads 14 near the focusing electrode 13. A focusing voltage, which is lower by thousands of voltages than an anode voltage, is applied to the metallic and 15, which is electrically connected to the focusing electrode 13.

Although, not shown here, a cathode ray tube for suppressing leakage currents causing an arc has been disclosed in U.S. Pat. No. 4,353,006 wherein, instead of the metallic band, a metallic coating layer is formed on the surface of the supporting beads.

However, since the aforesaid conventional arc suppressing means are provided by a process separate than the manufacturing process of the electron gun, the manufacturing efficiency is reduced and the manufacturing complexity and cost are increased.

SUMMARY OF THE INVENTION

The object of the present invention is to provide a cathode ray tube having an arc suppressing means, which can eliminate the aforementioned defects and enhance productivity with a simple structure.

To achieve the object, according to the present invention, a cathode ray tube comprises an evacuated glass envelope including a funnel having a neck and a panel provided with a shadow mask. An electron-gun is housed in the neck. The cathode ray tube further comprises a cathode and a plurality of electrodes supported by supporting beads. On the outer surface of a focusing electrode, at least one or more projecting metallic pieces pass through the supporting beads and extend up to the surface of the supporting beads. The ends of the pieces are exposed outside of the supporting beads, and as a result, effectively suppress any arcing which occurs in the bead channels.

BRIEF DESCRIPTION OF THE DRAWINGS

Other objects and advantages of the present invention will be apparent from the embodiment described with reference to the accompanying drawings, in which.

DETAILED DESCRIPTION OF THE PREFERRED EMBODIMENT

Figure 1:
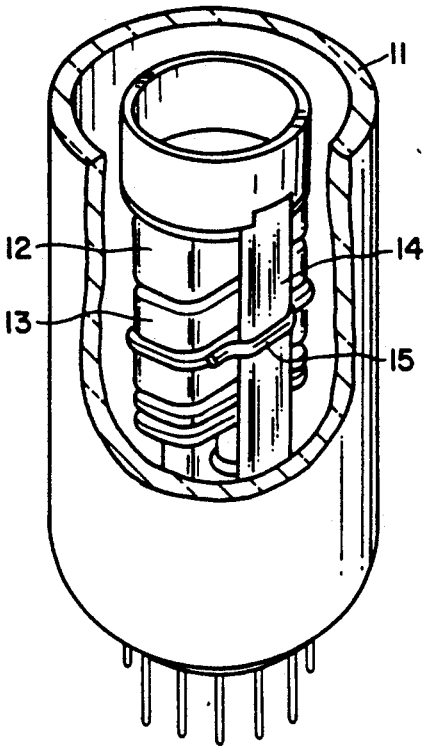
FIG. 1 (PRIOR ART)
FIG. 1 is a partially broken away perspective view of a neck of a cathode ray tube storing a conventional electron gun.
Figure 2:
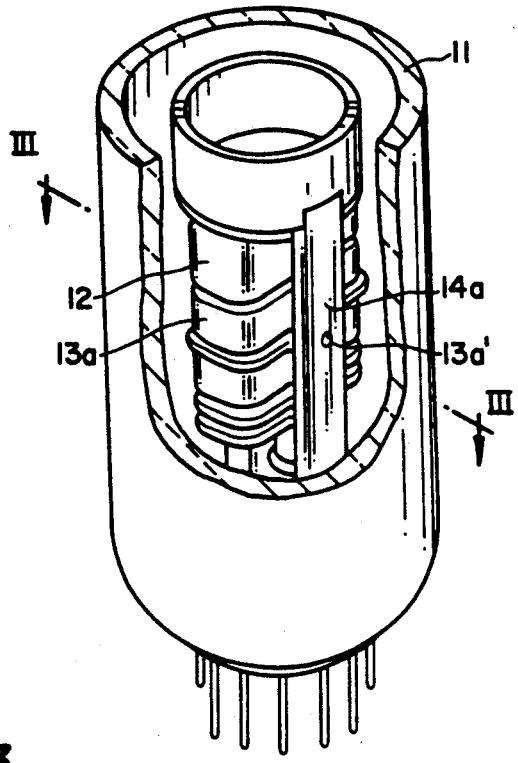
FIG. 2 is a partially broken away perspective view of the neck of a cathode ray tube housing an electron gun according to the present invention.

As shown in FIG. 2, the electron gun is housed within the neck 11, which is the rear portion of the funnel of a cathode ray tube (not shown). The electron gun comprises a plurality of electrodes, including an anode electrode 12 and focusing electrode 13*a*, which are supported by a pair of supporting beads 14*a*.

On the respective side planes of the focusing electrode 13*a*, two opposite projecting pieces 13*a*′ which are electrically connected to the focusing electrode 13*a* extend through and to the outer surface of, the respective supporting beads 14*a*. The ends of projecting pieces 13*a*′ are exposed to the outside of the supporting bead 14*a*, facing the inner surface of the neck 11.

Figure 3:
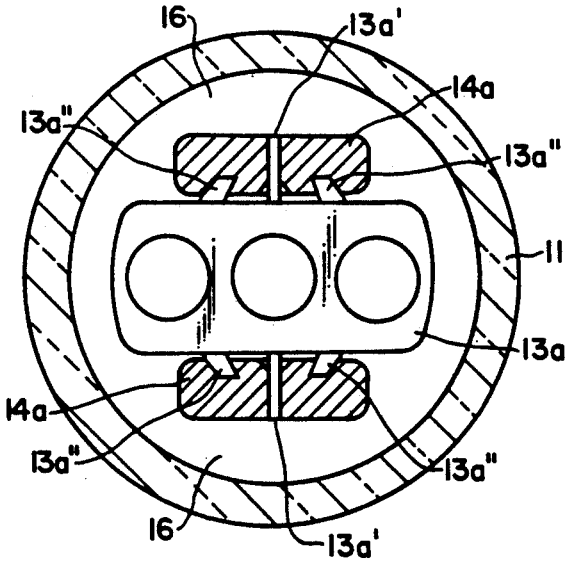
FIG. 3 is a cross sectional view taken along line III—III of the neck of a cathode ray tube shown in FIG. 2.
Figure 4:
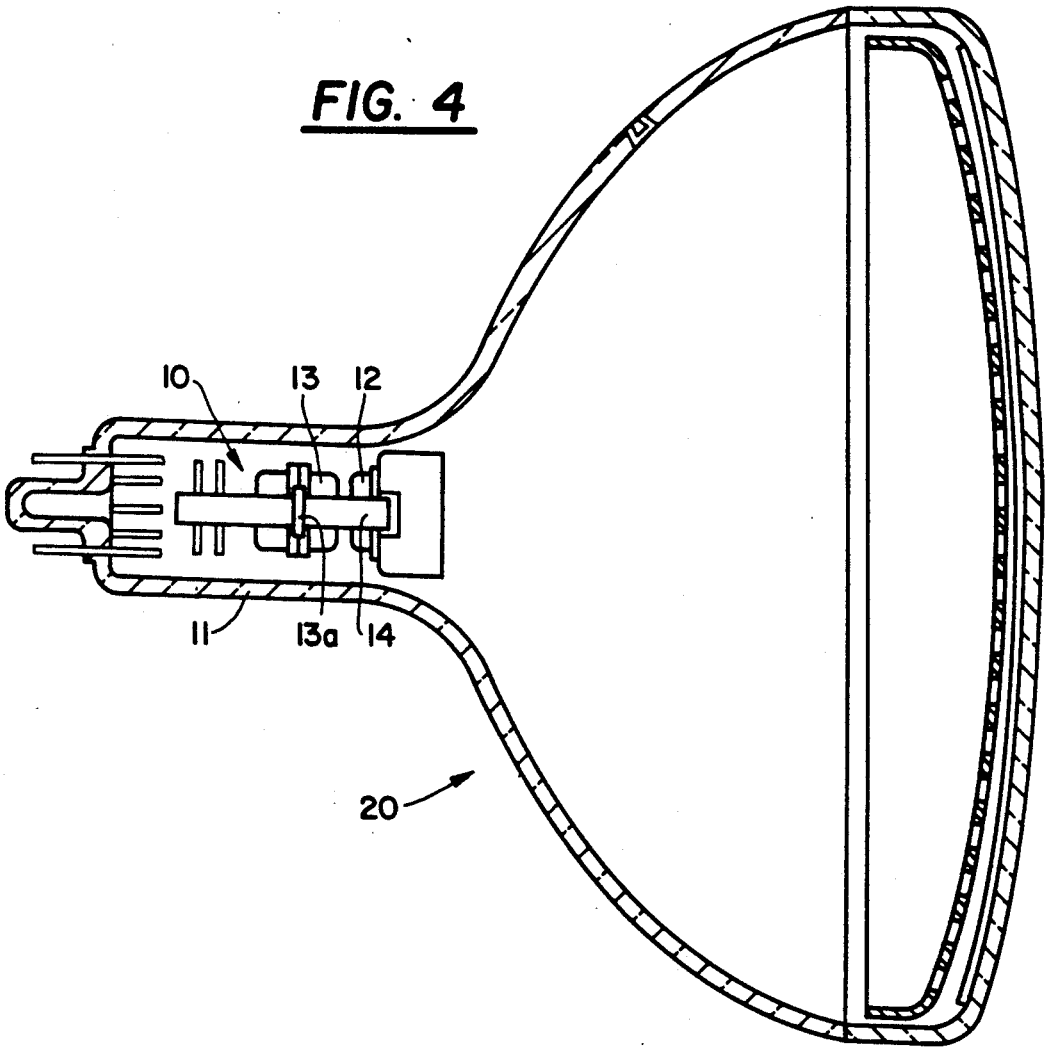
FIG. 4 is a complete representation of a perspective view of a conventional cathode ray tube employing an electron gun as in prior art FIG. 1.

In more detail, as shown in FIG. 3, at the centers of both side planes of the focusing electrode 13*a*, two elongated projecting pieces 13*a*′ and 13*a*′ are formed through the supporting beads 14*a*. On opposite sides of the projecting pieces 13*a*′ there are formed a pair of anchors 13*a*″ and 13*a*″ which are embedded into the supporting bead 14*a* to secure the focusing electrode 13*a* to the supporting bead 14*a*. The projecting pieces 13*a*′ and the anchors 13*a* are preferably to be integrally formed with the focusing electrode 13*a*. A plurality of projecting pieces 13*a*′ may be formed at one side plane of the focusing electrode 13*a*. The projecting pieces 13*a*′ are preferably formed such that the ends of the projecting pieces 13*a*′ are the same level as the outer surface of the supporting bead 14*a*. If the ends of the projecting pieces 13*a*′ protrudes above the surface of the supporting bead 14*a*, arcing between the ends of the projecting pieces 13*a*′ and the inner surface of the neck 11 may occur due to the short distance therebetween. On the other hand, if the projecting pieces 13*a*′ do not reach the outer surface of the supporting bead 14*a*, an electric field can not be formed sufficiently enough to suppress the arcing, as will be described later.

In the cathode ray tube of the present invention as constructed above, the ends of the elongated projecting pieces 13a are formed at the focusing electrode 13a' is exposed to the outside of the supporting bead 14a to face the inner surface of the neck 11. Leakage currents normally occur in the bead channels 16, formed between the supporting bead 14a and the inner surface of the neck 11. An electric field of an intermediate potential between a high potential applied tot he focusing electrode 13a and a low potential applied to the inner surface of the neck 11 is formed in the bead channels 16. The electric field of an intermediate potential can effectively suppress arcing.

As described above, the arc suppressing means according to the present invention prevents leakage currents from traveling through the bead channels 16 with a simpler structure than that of the conventional arc suppressing means.

The arc suppressing means of the present invention may be integrally formed with the focusing anode electrode. Unlike the conventional are suppressing means wherein a separate band or metal coating layer must be applied in a separate manufacturing step, the projecting piece serving as the arc suppressing means of the present invention may be formed simultaneously with the manufacturing of the focusing electrode. The projecting piece is then embedded into the supporting bead together with the anchors during the assembling process of the electron gun. Thus the process for manufacturing the electron gun is simplified and the manufacturing costs reduced. Further, the projecting piece reinforces the fixing of the focusing electrode to the supporting bead.

What is claimed is:

1. An improved arc suppressing electron gun in a cathode ray tube, said cathode ray tube having an evacuated glass envelope which includes a funnel having a panel portion housing a shadow mask therein and a neck portion housing said arc suppressing electron gun therein, said electron gun comprising:

a plurality of electrodes including an anode electrode and a focusing electrode disposed adjacent to each other; and at least one supporting bead to support said plurality of electrodes, said supporting bead having an inner surface facing said electrodes and an outer surface facing an inside surface of said neck portion;

wherein one of said plurality of electrodes includes on an outer surface thereof at least one projecting metal piece, said metal piece passing entirely through said supporting bead such that an end of said metal piece is level with the outer surface of said supporting bead so as to suppress arcing in a space region of said neck portion defined by the outer surface of said at least one supporting bead and said inside surface of said neck portion.

2. An improved arc suppressing electron gun as in claim 1, wherein said metal piece is integrally formed with said focusing electrode.

* * * * *